US006092793A

United States Patent [19]

Yanagii

[11] Patent Number: 6,092,793

[45] Date of Patent: Jul. 25, 2000

[54] CONSTANT VACUUM TYPE CARBURETOR

[75] Inventor: Yoichi Yanagii, Kouhoku-ku, Japan

[73] Assignee: Keihin Corporation, Tokyo, Japan

[21] Appl. No.: 09/141,029

[22] Filed: Aug. 27, 1998

[30] Foreign Application Priority Data

Apr. 30, 1998 [JP] Japan ..... 10-136109

[51] Int. Cl.[7] ..... F02M 17/04

[52] U.S. Cl. ..... 261/35; 261/69.1; 261/DIG. 38; 261/DIG. 68

[58] Field of Search ..... 261/35, 69.1, DIG. 38, 261/DIG. 68

[56] References Cited

U.S. PATENT DOCUMENTS

| | | | |
|---|---|---|---|
| 3,174,731 | 3/1965 | Kalert, Jr. | 261/DIG. 68 |
| 3,640,512 | 2/1972 | Morgenroth | 261/DIG. 68 |
| 3,738,623 | 6/1973 | Tuckey | 261/35 |
| 3,825,237 | 7/1974 | Aoyama et al. | 261/35 |
| 4,323,521 | 4/1982 | Morgenroth | 261/DIG. 38 |
| 4,481,152 | 11/1984 | Kobayashi et al. | 261/DIG. 68 |
| 4,632,788 | 12/1986 | Jones | 261/69.1 X |
| 5,599,484 | 2/1997 | Tobinai | 261/DIG. 68 |
| 5,720,906 | 2/1998 | Yamanaka et al. | 261/35 |

FOREIGN PATENT DOCUMENTS

| | | | |
|---|---|---|---|
| 1218194 | 5/1960 | France | 261/35 |
| 2-37158 | 2/1990 | Japan | 261/DIG. 68 |
| 4-339161 | 11/1992 | Japan | 261/DIG. 68 |
| 5-272414 | 10/1993 | Japan | 261/DIG. 38 |

*Primary Examiner*—Richard L. Chiesa
*Attorney, Agent, or Firm*—Pillsbury Madison & Sutro LLP

[57] ABSTRACT

A vacuum actuated valve for a constant vacuum type carburetor is formed with a first guide hole, a jet needle engaging step portion and a jet needle insertion hole therein. A spring seat has an outer cylindrical portion in an upper portion thereof, and an inner cylindrical portion and a jet needle supporting cylindrical portion therein. The outer cylindrical portion of the spring seat is arranged on the outer circumference of a diaphragm plate. The jet needle supporting cylindrical portion is inserted within a first guide hole. A lower end of a vacuum actuated valve return spring engages with a spring seating flange of the spring seat. A flange portion of a jet needle is restricted by the jet needle engaging step portion and the jet needle supporting cylindrical portion.

3 Claims, 1 Drawing Sheet

CONSTANT VACUUM TYPE CARBURETOR

BACKGROUND OF THE INVENTION

1. Field of the Invention

The present invention relates to a constant vacuum type carburetor having a vacuum actuated valve driven up and down within an air induction passage by a vacuum pressure generated in the air induction passage on an upstream side of a throttle valve.

2. Description of the Related Art

The conventional constant vacuum type carburetor has been disclosed in a commonly owned Japanese Examined Patent Publication No. Heisei 1(1989)-35173. In the disclosed constant vacuum type carburetor, an air induction passage is formed through a carburetor main body. Also, a guide cylinder of a vacuum actuated valve is extended upwardly from the air induction passage with an upward opening.

Within the guide cylinder of the vacuum actuated valve, a vacuum actuated valve is arranged for up and down movement. On the upper end of the vacuum actuated valve, a diaphragm is arranged the inner periphery thereof is clamped with a diaphragm plate. Thus, a pressure receiving chamber is defined between an upper surface of the diaphragm and a top cover covering the upper side of the diaphragm. Also, an atmospheric pressure chamber is defined by a lower surface of the diaphragm and a recessed portion of the carburetor main body.

On the other hand, within the vacuum actuated valve, a jet needle is arranged to project toward the lower end thereof. Movement of the jet needle in the longitudinal direction is restricted by a jet needle holder which is formed by a thread member or so forth, arranged corresponding to the upper end of the jet needle.

A vacuum actuated valve return spring is arranged within the pressure receiving chamber in compressed position. The lower end of the vacuum actuated valve return spring is directly engaged with the inside of the vacuum actuated valve. On the other hand, the upper end of the vacuum actuated valve return spring is engaged with the top cover.

In the conventional constant vacuum type carburetor, there has been proposed the vacuum actuated valve which is provided with a thin plate shaped cross-section (for example, see Japanese Examined Utility Model Publication No. Showa 43(1968)-23922). This measure has been taken to improve air induction efficiency for an intake air flowing through the air induction passage, or for down-sizing of the carburetor main body. When the thin plate form vacuum actuated valve is employed, a problem is encountered in directly engaging the vacuum actuated valve return spring to the inside of the vacuum actuated valve. This is because a diameter of the vacuum actuated valve return spring becomes small requiring a large spring constant to assure the fine and smooth lifting characteristics of the vacuum actuated valve in response to increasing of vacuum pressure in the pressure receiving chamber. Consequently, a long period is necessary to conduct an adaptation test of the carburetor. Also, installation ease of the vacuum actuated valve return spring into the vacuum actuated valve is degraded. Furthermore, a difficulty is encountered in arranging the jet needle holder within the vacuum actuated valve.

On the other hand, as a material of the vacuum actuated valve, a synthetic resin material has been used for light weight and low production cost. Particularly, in order to maintain dimensional precision and to obtain sufficient mechanical strength, a glass fiber reinforced synthetic resin is used. Also, a diaphragm plate to be fixedly arranged in the vacuum actuated valve by thermal welding is formed of glass fiber reinforced synthetic resin. The reason for this is that, upon thermal welding of the vacuum actuated valve and the diaphragm plate, both members have to be connected by thermal welding.

Similarly to the above, the top cover is also formed of glass fiber reinforced synthetic resin for lightweight and low production cost.

In the constant vacuum type carburetor constructed as set forth above, a fully open position of the vacuum actuated valve is determined by abutting the diaphragm plate of the vacuum actuated valve to the top cover. Therefore, in a long period use, both components formed of glass fiber reinforced synthetic resin can wear.

SUMMARY OF THE INVENTION

Therefore in view of the drawbacks in the conventional constant vacuum type carburetor, it is an object of the present invention to provide a constant vacuum type carburetor which can easily achieve smooth lift characteristics of a vacuum actuated valve, can certainly restrict movement of a jet needle in the longitudinal direction and can accurately maintain a fully open position of the vacuum actuated valve for a long period, when a thin plate form vacuum actuated valve is employed.

According to one aspect of the present invention, a constant vacuum type carburetor comprises:

a vacuum actuated valve disposed within a vacuum actuated valve guide cylinder located on upstream side of a throttle valve in movable fashion, the vacuum actuated valve defining a first guide hole, a jet needle engaging step portion and a jet needle insertion hole;

a diaphragm arranged in an upper end portion of the vacuum actuated valve for defining an atmospheric pressure chamber and a pressure receiving chamber, the inner peripheral portion of the diaphragm being clamped between a flange portion on the upper end of the vacuum actuated valve and a diaphragm plate;

a vacuum actuated valve return spring disposed within the pressure receiving chamber in compressed fashion;

a spring seat arranged in opposition to the pressure receiving chamber and including an inner jet needle supporting cylindrical portion inserted into the first guide hole of the vacuum actuated valve and an outer spring engaging flange portion engaging with a lower end of the vacuum actuated valve return spring, the jet needle supporting cylindrical portion of the spring seat being inserted within the first guide hole of the vacuum actuated valve; and a jet needle movement in the longitudinal direction being restricted by the jet needle engaging step portion and the end portion of the jet needle supporting cylinder portion.

In the preferred construction, a full open restricting cylindrical portion may be formed integrally with the jet needle supporting cylindrical portion of the spring seat to extend upwardly, for defining a full open position of the vacuum actuated valve by abutting the full opening restricting cylindrical portion with a top cover. The spring seat may be provided with an engaging claw portion releasably engaging with an engaging step portion provided in the diaphragm plate.

Since the constant vacuum type carburetor is provided with a particular spring seat which includes the jet needle supporting cylindrical portion and the spring seating flange portion. The spring seat is mounted on the vacuum actuated valve by engaging the engaging claw portion with the engaging step portion of the diaphragm plate. Since the flange portion of the jet needle is disposed between the jet needle engaging step portion and the end portion of the jet needle supporting cylindrical portion of the spring seat, movement of the jet needle in the longitudinal direction (up and down direction in FIG. 1) can be successfully restricted.

The foregoing construction is mounted on the vacuum actuated valve in a form of sub-assembly. Therefore, drop out of the jet needle from the vacuum actuated valve is not needed to improve assembling ease.

Also, the jet needle forms a setting part of the carburetor and is potentially exchanged. Upon exchanging of the jet needle, the spring seat can be easily removed from the vacuum actuated valve by depressing the engaging claw portion inwardly to release engagement with the engaging step portion. By this, the jet needle can be exchanged quite easily.

Furthermore, by engaging the lower end of the vacuum actuated valve return spring with the spring engaging flange portion of the spring seat, the inner diameter of the spring can be selected optimally without being influenced by the shape of the vacuum actuated valve, i.e. even when the vacuum actuated valve is in thin plate form. Therefore, a lifting characteristic for smoothly lifting the vacuum actuated valve in response to increasing of the vacuum pressure in the pressure receiving chamber can be obtained quite easily. When the vacuum actuated valve is formed into the thin plate shaped configuration, the lower end of the vacuum actuated valve return spring is not necessary to arrange within the vacuum actuated valve. Therefore, installation ease of the vacuum actuated valve return spring can be improved.

In addition, the spring seat is not required to have a function for mounting the diaphragm onto the vacuum actuated valve. The spring seat valve is mounted by engaging the engaging claw portion with the engaging step portion of the diaphragm plate. Thus an optimal synthetic resin material (such as glass fiber reinforced synthetic resin material) can be selected as a material of the spring seat irrespective of the material of the vacuum actuated valve. For example, polyacetal resin (POM) may be used as the material of the spring seat. Thus, even when the full open position of the vacuum actuated valve is restricted by contacting the spring seat onto the top cover, wearing of the spring seat can be successfully restricted to maintain the full open position of the vacuum actuated valve accurately for a long period.

On the other hand, a full open restricting cylindrical portion is formed by upwardly extending the jet needle supporting cylindrical portion of the spring seat so that the full open position of the vacuum actuated valve can be accurately restricted by abutting the full open restricting cylindrical portion onto the top cover. By this, the full open position of the vacuum actuated valve can be quite easily varied by varying projecting height of the full open restricting cylindrical portion. Accordingly, the constant vacuum type carburetor having high general applicability for the engine can be attained.

BRIEF DESCRIPTION OF THE DRAWINGS

The present invention will be understood more fully from the detailed description given herebelow and from the accompanying drawings of the preferred embodiment of the present invention, which, however, should not be taken to be limitative to the invention, but are for explanation and understanding only.

In the drawings.

DETAILED DESCRIPTION OF THE PRESENT INVENTION

Figure 1:
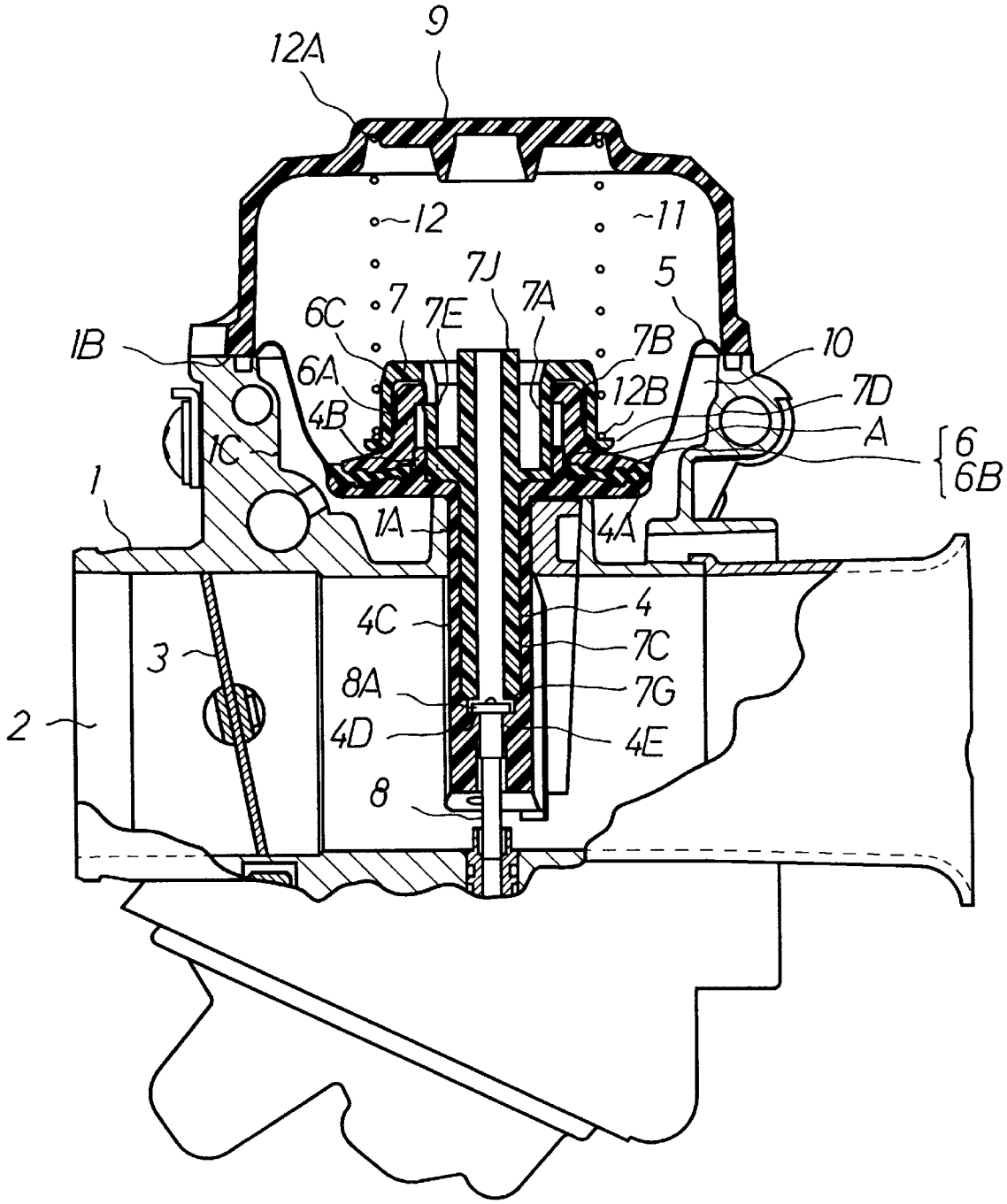
FIG. 1 is a section of the preferred embodiment of a constant vacuum type carburetor according to the present invention.

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

One embodiment of a constant vacuum type carburetor according to the present invention will be discussed hereinafter in detail with reference to the FIG. 1.

In the drawing, the reference numeral 1 denotes a carburetor main body, through which an air induction passage 2 extends transversely. The air induction passage 2 is adapted to be opened and closed by a throttle valve 3. On the upstream side of the throttle valve 3 in the air induction passage 2 (right side in the drawing), a guide cylinder 1A of a vacuum actuated valve is communicated to extend upwardly. On the outer periphery of the guide cylinder 1A of the vacuum actuated valve, a recessed portion 1C of a carburetor body opening toward the upper end 1B is formed.

The reference numeral 4 denotes a vacuum actuated valve slidably disposed within the guide cylinder 1A thereof for controlling an opening area of the air induction passage 2. The vacuum actuated valve 4 is integrally formed with a radially extending disc shaped flange portion 4A and a coupling cylindrical portion 4B extending upwardly from the flange portion 4A. Within the vacuum actuated valve 4, a first guide hole 4C, a jet needle engaging step portion 4D and a jet needle insertion hole 4E are formed in vertical alignment. The first guide hole 4C opens upwardly. On the other hand, the jet needle insertion hole 4E opens downwardly. The jet needle engaging step portion 4D is oriented upwardly. The vacuum actuated valve 4 is thin plate shaped configuration in a portion extending across the air induction passage, and is formed of a glass fiber reinforced synthetic resin material.

The reference numeral 5 denotes a convex diaphragm. The inner peripheral portion of the diaphragm 5 is disposed on the flange portion 4A of the vacuum actuated valve 4. The outer peripheral portion is arranged on the upper end 1B of the carburetor main body 1.

The reference numeral 6 denotes a diaphragm plate which includes a cylindrical portion 6A arranged on the outer periphery of the cylindrical portion 4B of the vacuum actuated valve 4 and a flange portion 6B extending radially from the lower end of the cylindrical portion 6A and arranged above the inner peripheral portion of the diaphragm 5. Also, an inward extension 6C is extended radially inward with covering the upper end of the cylindrical portion 4B of the vacuum actuated valve 4. The diaphragm plate 6 is formed of glass fiber reinforced synthetic resin material which is the same material as the vacuum actuated valve 4.

The diaphragm 5 is mounted on the vacuum actuated valve 4 in the following manner. The inner peripheral portion of the diaphragm 5 is arranged on the flange portion 4A of the vacuum actuated valve 4. On the other hand, the flange portion 6B of the diaphragm plate 6 is arranged on the inner peripheral portion of the diaphragm 5. In conjunction therewith, the cylindrical portion 6A of the diaphragm plate 6 is arranged on the outer periphery of the cylindrical portion 4B of the vacuum actuated valve 4. In the assembled condition as set forth above, the diaphragm plate 6 is rigidly fixed on the vacuum actuated valve 4 by way of thermal welding. Thermal welding is performed for portion A in the sole figure. With the construction set forth above, the inner peripheral portion of the diaphragm 5 is clamped between the flange portion 4A of the vacuum actuated valve 4 and the flange portion 6B of the diaphragm plate 6.

The reference numeral 7 denotes a spring seat formed of a synthetic resin material. The spring seat 7 includes an inner cylindrical portion 7A arranged inside of the cylindrical portion 6A of the vacuum actuated valve 4 and an outer cylindrical portion 7B formed outside of the inner cylindrical portion 7A across an annular gap define center between. At the center portion of the inner cylindrical portion 6A, a jet needle supporting cylindrical portion 7C inserted into the first guide hole 4C of the vacuum actuated valve 4, is formed with projecting downwardly. On the other hand, on the lower end of the outer cylindrical portion 7B, a spring seating flange portion 7D is extended radially outward. An outwardly extending claw portion 7E engaging with the inward extension 6C of the diaphragm plate 6, is formed extending from the upper end of the inner cylindrical portion 7A. On the outer cylindrical portion 7B and the inner cylindrical portion 7A, a plurality of grooves (not shown) extending in vertical direction are formed for causing inward elastic deformation of the outwardly extending claw portion 7E by applying an external force.

The constant vacuum type carburetor constructed as set forth above is assembled in the following manner.

As set forth above, the diaphragm 5 and the diaphragm plate 6 are mounted on the vacuum actuated valve 4. In this condition, the jet needle 8 is inserted into the jet needle insertion hole 4E from the upper side of the vacuum actuated valve 4 through the first guide hole 4C. By this, a flange portion 8A integrally mounted on the upper end of the jet needle 8 is positioned on the jet needle engaging step portion 4D. The jet needle 8 projecting downwardly from the lower end of the vacuum actuated valve 4 is inserted into a needle jet opening to the air induction passage 2.

Next, the spring seat 7 is mounted on the vacuum actuated valve 4. Namely, the inner cylindrical portion 7A is arranged inside of the cylindrical portion 6A of the diaphragm plate 6 and the cylindrical portion 4B of the vacuum actuated valve 4. The jet needle supporting cylindrical portion 7C of the spring seat 7 is inserted within the first guide hole 4C. The outer cylindrical portion 7B is arranged on the outer periphery of the cylindrical portion 6A of the diaphragm plate 6. Through the process set forth above, the end portion 7G of the jet needle supporting cylindrical portion 7C is arranged in opposition to the flange portion 8A of the jet needle 8. By this, the flange portion 8A of the jet needle 8 is arranged between the jet needle engaging step portion 4D of the vacuum actuated valve 4 and the end portion 7G of the jet needle supporting cylindrical portion 7C. By this, movement of the jet needle in the longitudinal direction can be restricted. On the other hand, the outwardly extending claw portion 7E of the spring seat 7 is engaged with the inward extension 6C of the diaphragm plate 6. Thus, the spring seat 7 is fixedly mounted on the vacuum actuated valve 4.

Then, as set forth above, the vacuum actuated valve 4 having the jet needle 8, the diaphragm 5, the diaphragm plate 6 and the spring seat 7 is arranged within the recessed portion 1C of the carburetor main body and the guide cylinder 1A of the vacuum actuated valve through one end 1B of the carburetor main body 1. On the other hand, the outer peripheral portion of the diaphragm 5 is arranged on the upper end 1B of the carburetor main body 1.

Then, a top cover 9 is arranged on the upper end 1B of he carburetor main body 1. In this condition, the top cover is fixed on the carburetor main body 1 by not shown screws. As set forth above, the outer peripheral portion of the diaphragm 5 is clamped between the upper end 1B of the carburetor main body 1 and the top cover 9. An atmospheric pressure chamber 10 is defined by a lower side surface of the diaphragm 5 and the recessed portion 1C of the carburetor main body 1. Also, a pressure receiving chamber 11 is defined between an upper side surface of the diaphragm 5 and the top cover 9.

On the other hand, within the pressure receiving chamber 11, a vacuum actuated valve return spring 12 is disposed in compressed fashion. The upper end 12A of the vacuum actuated valve return spring 12 is engaged with the top cover 9, and the lower end 12B of the vacuum actuated valve return spring 12 is engaged to the spring seating flange portion 7D of the spring seat 7.

In the preferred embodiment of the constant vacuum type carburetor according to the present invention constructed as set forth above, the following effect can be attained by providing a particular spring seat 7 and the jet needle supporting cylindrical portion 7C and the spring seating flange portion 7D are provided in the spring seat 7. The spring seat 7 is mounted on the vacuum actuated valve 4 by engaging the outwardly extending claw portion 7E with the inward extension 6C of the diaphragm plate 6. Since the flange portion 8A of the jet needle 8 is disposed between the jet needle engaging step portion 4D and the end portion 7G of the jet needle supporting cylindrical portion 7C of the spring seat 7, movement of the jet needle 8 in the longitudinal direction (up and down direction in the FIG. 1) can be successfully restricted.

On the other hand, the foregoing construction is mounted on the vacuum actuated valve in a form of sub-assembly. Therefore, drop out of the jet needle 8 from the vacuum actuated valve 4 is not needed to improve assembling ease.

Also, the jet needle 8 forms a setting parts of the carburetor and is potentially exchanged. Upon exchanging of the jet needle 8, the spring seat 7 can be easily removed from the vacuum actuated valve 4 by depressing the outwardly extending claw 7E inwardly to release engagement with the outward extension 6C. By this, the jet needle 8 can be exchanged quite easily.

Furthermore, by engaging the lower end of the vacuum actuated valve return spring 12 with the spring engaging flange portion 7D of the spring seat 7, the inner diameter of the spring 12 can be selected optimally without being influenced by the shape of the vacuum actuated valve, i.e. even when the vacuum actuated valve is in thin plate form. Therefore, a lifting characteristic for smoothly lifting the vacuum actuated valve in response to increasing of the vacuum pressure in the pressure receiving chamber 11 can be obtained quite easily. When the vacuum actuated valve 4 is formed into the thin plate shaped configuration, the lower end 12B of the vacuum actuated valve return spring 12 is not necessary to arrange within the vacuum actuated valve. Therefore, installation ease of the vacuum actuated valve return spring 12 can be improved.

In addition, the spring seat 7 is not required to have a function for mounting the diaphragm 5 onto the vacuum actuated valve 4. The spring set 7 is mounted by engaging the outwardly extending claw portion 7E with the inward extension 6C of the diaphragm plate 6. Optimal synthetic resin material (such as glass fiber reinforced synthetic resin material) can be selected as a material of the spring seat irrespective of the material of the vacuum actuated valve 4. For example, polyacetal resin (POM) may be used as the material of the spring seat. Thus, even when the full open position of the vacuum actuated valve 4 is restricted by contacting the spring seat 7 onto the top cover, wearing of the spring seat 7 can be successfully reduced to maintain the full open position of the vacuum actuated valve 4 accurately for a long period.

On the other hand, a full open restricting cylindrical portion 7J is formed by upwardly extending the jet needle supporting cylindrical portion 7C of the spring seat 7 so that the full open position of the vacuum actuated valve 4 can be accurately restricted by abutting the full open restricting cylindrical portion 7J onto the top cover 9. By this, the full open position of the vacuum actuated valve 4 can be quite easily varied by varying projecting height of the full open restricting cylindrical portion 7J. Accordingly, the constant vacuum type carburetor having high general applicability for the engine can be attained.

Although the present invention has been illustrated and described with respect to an exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A constant vacuum carburetor comprising:

a vacuum actuated valve disposed within a vacuum actuated valve guide cylinder located on upstream side of a throttle valve in movable fashion, said vacuum actuated valve defining a first guide hole, a jet needle engaging step portion and a jet needle insertion hole;

a diaphragm arranged in an upper end portion of said vacuum actuated valve for defining an atmospheric pressure chamber and a pressure receiving chamber, the inner peripheral portion of said diaphragm being clamped between a flange portion on the upper end of said vacuum actuated valve and a diaphragm plate;

a vacuum actuated valve return spring disposed within said pressure receiving chamber in compressed fashion;

a spring seat arranged in opposition to said pressure receiving chamber and including an inner jet needle supporting cylindrical portion inserted into said first guide hole of said vacuum actuated valve and an outer spring engaging flange portion engaging with a lower end of said vacuum actuated valve return spring, said jet needle supporting cylindrical portion of said spring seat being inserted within said first guide hole of said vacuum actuated valve; and a jet needle movement in the longitudinal direction being restricted by said jet needle engaging step portion and the end portion of said jet needle supporting cylinder portion.

2. A constant vacuum carburetor as set forth in claim 1, wherein a full open restricting cylindrical portion is formed integrally with said jet needle supporting cylindrical portion of said spring seat to extent upwardly, for defining a full open position of said vacuum actuated valve by abutting said full opening restricting cylindrical portion with a top cover.

3. A constant vacuum carburetor as set forth in claim 1, wherein said spring seat is provided with an engaging claw portion releasably engaging with an engaging step portion provided in said diaphragm plate.

* * * * *